US010141174B2

(12) United States Patent
Aliman et al.

(10) Patent No.: US 10,141,174 B2
(45) Date of Patent: Nov. 27, 2018

(54) METHOD FOR EXAMINING A GAS BY MASS SPECTROMETRY AND MASS SPECTROMETER

(71) Applicant: Carl Zeiss SMT GmbH, Oberkochen (DE)

(72) Inventors: Michel Aliman, Oberkochen (DE); Alexander Laue, Heidenheim (DE); Hin Yiu Anthony Chung, Ulm (DE); Gennady Fedosenko, Aalen (DE); Ruediger Reuter, Aalen (DE); Leonid Gorkhover, Ulm (DE); Martin Antoni, Aalen (DE); Andreas Gorus, Essingen (DE); Valerie Derpmann, Aalen (DE)

(73) Assignee: Carl Zeiss SMT GmbH, Oberkochen (DE)

( * ) Notice: Subject to any disclaimer, the term of this patent is extended or adjusted under 35 U.S.C. 154(b) by 0 days.

(21) Appl. No.: 15/795,405

(22) Filed: Oct. 27, 2017

(65) Prior Publication Data

US 2018/0068842 A1 Mar. 8, 2018

Related U.S. Application Data

(63) Continuation of application No. PCT/EP2017/055842, filed on Mar. 17, 2016.

(30) Foreign Application Priority Data

May 4, 2015 (DE) ..... 10 2015 208 188

(51) Int. Cl.
*H01J 49/38* (2006.01)
*H01J 49/42* (2006.01)
(Continued)

(52) U.S. Cl.
CPC ..... *H01J 49/38* (2013.01); *H01J 49/0031* (2013.01); *H01J 49/425* (2013.01); *H01J 49/426* (2013.01);
(Continued)

(58) Field of Classification Search
None
See application file for complete search history.

(56) References Cited

U.S. PATENT DOCUMENTS 4,761,545 A * 8/1988 Marshall ..... H01J 49/38 250/282
4,931,640 A * 6/1990 Marshall ..... H01J 49/38 250/281
(Continued)

FOREIGN PATENT DOCUMENTS

DE 195 01 823 A1 7/1996
DE 103 93 404 T5 10/2005
(Continued)

OTHER PUBLICATIONS

M. Aliman and A. Glasmachers, "A novel electric ion resonance cell design with high signal-to-noise ratio and low distortion for Fourier transform mass spectrometry", Journal of The American Society for Mass Spectrometry; vol. 10, No. 10, Oct. 1999.
(Continued)

*Primary Examiner* — Michael J Logie
(74) *Attorney, Agent, or Firm* — Fish & Richardson P.C.

(57) ABSTRACT

A method for examining a gas by mass spectrometry includes: ionizing the gas for producing ions; and storing, exciting and detecting at least some of the produced ions in an FT ion trap. Producing and storing the ions in the FT ion trap and/or exciting the ions prior to the detection of the ions in the FT ion trap includes at least one selective IFT excitation, such as a SWIFT excitation, which is dependent
(Continued)

on the mass-to-charge ratio of the ions. The disclosure further relates to a mass spectrometer. A mass spectrometer includes: an FT ion trap; and an excitation device for storing, exciting, and detecting ions in the FT ion trap.

21 Claims, 5 Drawing Sheets

(51) Int. Cl.
*H01J 49/00* (2006.01)
*H01J 49/02* (2006.01)

(52) U.S. Cl.
CPC ..... *H01J 49/427* (2013.01); *H01J 49/4295* (2013.01); *H01J 49/027* (2013.01)

(56) References Cited

U.S. PATENT DOCUMENTS 4,945,234 A 7/1990 Goodman et al.
5,013,912 A * 5/1991 Guan ..... H01J 49/38 250/282
5,324,939 A * 6/1994 Louris ..... H01J 49/428 250/291
5,517,025 A * 5/1996 Wells ..... H01J 49/427 250/282
5,654,542 A * 8/1997 Schubert ..... H01J 49/428 250/282
5,696,376 A * 12/1997 Doroshenko ..... H01J 49/424 250/282
5,710,427 A 1/1998 Schubert et al.
2005/0009172 A1* 1/2005 Yamakoshi ..... H01J 49/162 435/287.2
2005/0236578 A1* 10/2005 Kawato ..... H01J 49/427 250/396 R
2009/0114810 A1* 5/2009 Green ..... H01J 49/4235 250/282
2014/0339424 A1 11/2014 Glasmachers et al.
2015/0255263 A1* 9/2015 Kodera ..... H01J 49/424 250/283
2015/0255265 A1* 9/2015 Xu ..... H01J 49/0095 250/282
2016/0111269 A1* 4/2016 Fedosenko ..... H01J 49/145 250/283

FOREIGN PATENT DOCUMENTS

DE 10 2013 208 959 A 11/2014
DE 10 2013 213 501 A1 1/2015
GB 2 470 664 A 12/2010
WO WO 2015/003819 A1 1/2015

OTHER PUBLICATIONS

S. Guan and A.G. Marshall, "Stored Waveform Inverse Fourier Transform Axial Excitation/Ejection for Quadrupole Ion Trap Mass Spectrometry", Anal. Chem. 1993, pp. 1288-1294.
Manish H. Soni et al., "Selective Injection and Isolation of Ions in Quadrupole Ion Trap Mass Spectrometry Using Notched Waveforms Created Using the Inverse Fourier Transforms," Analytical Chemistry, vol. 66, No. 15, Aug. 1, 1994, pp. 2488-2496, XP055277120.
Michael Schmidt et al., "Using a Fourier-transform quadrupole ion trap operating with advanced ion excitation methods for high performance mass analysis of organic hydrocarbons", 62th ASMS Conference 2014, Jun. 19, 2014 (Jun. 19, 2014), p. 1, XP055276790, Baltimore, USA.
Soni M et al., "Broad-Band Fourier Transform Quadrupole Ion Trap Mass Spectrometry," Analytical Chemistry, American Chemical Society, vol. 68, No. 19, Oct. 1, 1996 (Oct. 1, 1996), pp. 3314-3320, XP000634974.
Translation of International Search Report for corresponding PCT Appl No. PCT/EP2016/055842, dated Aug. 10, 2016. (4 pages).
German Office Action, with translation thereof, for corresponding Appl No. 10 2015 208 188.5, dated Apr. 15, 2016.

* cited by examiner

METHOD FOR EXAMINING A GAS BY MASS SPECTROMETRY AND MASS SPECTROMETER

CROSS-REFERENCE TO RELATED APPLICATIONS

The present application is a continuation of, and claims benefit under 35 USC 120 to, international application PCT/EP2016/055842, filed Mar. 17, 2016, which claims benefit under 35 USC 119 of German Application No. DE 10 2015 208 188.5 dated May 4, 2015. The entire disclosure of these applications are incorporated by reference herein.

FIELD

The disclosure relates to methods for examining a gas by mass spectrometry, and to mass spectrometers.

BACKGROUND

Ion storage, ion separation, and ion detection are the principal functions of conventional mass spectrometers, which are generally housed in different components. As a consequence, interfaces that are typically complicated are often used between the components, rendering more difficult, firstly, a compact and efficient solution and, secondly, a quick manipulation of the ion populations. Moreover, there are signal losses, which reduces power and sensitivity of mass spectrometers, associated with the transfer of ions through the interfaces. By contrast, many functions (e.g. ion production, ion storage, and ion detection) can be unified "in situ" in the same ion trap and very compactly in the case of an electric or, optionally, magnetic Fourier transform ion trap (abbreviated: FT ion trap).

Ions or ionized gas constituents can be measured in a non-reactive manner and without interruption, and can be verified or detected according to their mass-to-charge ratio in such an FT iron trap, as described in e.g. the article: "A novel electric ion resonance cell design with high signal-to-noise ratio and low distortion for Fourier transform mass spectrometry", by M. Aliman and A. Glasmachers, Journal of The American Society for Mass Spectrometry; Vol. 10, No. 10, October 1999.

An example of a mass spectrometer with an electric FT ion trap is described in DE 10 2013 208 959 A. The FT ion trap has a ring electrode and two further electrodes (cap electrodes). The ions stored in the FT ion trap are excited in situ and the detection of the excited ions is effectuated by recording and evaluating mirror charges which the stored ions induce on the cap electrodes of the FT ion trap. In order to measure mirror charges, the ions stored in the FT ion trap are excited (stimulated) in a broadband fashion in situ and the ions oscillate at characteristic resonance frequencies in the ion trap, depending on the mass-charge ratio. This procedure differs fundamentally from the conventional destructive detection methods, in which the ions are no longer available after the measurement.

WO 2015/003819 A1 discloses the practice of removing individual ion populations from the ion trap or suppressing the ion populations if the particle number thereof exceeds a predetermined threshold at a given mass-to-charge ratio in an FT-ICR ("Fourier transform ion cyclotron resonance") trap by way of an IFT excitation in the form of a so-called SWIFT ("storage wave-form inverse Fourier transform") excitation. In this way, it is possible to remove large ion populations from the ion trap such that certain subsets of ion populations can be measured more accurately.

SUMMARY

The disclosure seeks to develop a method for examining a gas by mass spectrometry and an associated mass spectrometer such that the capability of the examination by mass spectrometry is increased.

According to a first aspect, a method includes producing and storing of the ions in the FT ion trap and/or exciting of the ions (immediately) before the detection of the ions in the FT ion trap includes at least one selective IFT ("inverse Fourier transform") excitation that is dependent on the mass-to-charge ratio or on the ion resonance frequencies of the ions, in particular a SWIFT ("storage wave form inverse Fourier transform") excitation.

It is proposed to carry out a selective ion excitation (also referred to as stimulation below), for example a broadband-selective ion stimulation in the same FT ion trap during the production and storage of the ions and/or immediately before the detection of the ions or the ion signals produced in the FT ion trap. Typically, such a stimulation is effectuated via a powerful IFT excitation, in particular via a SWIFT excitation, which facilitates a significant increase in the capability of the mass spectrometer in which the FT ion trap is integrated. In this way, it is also possible to carry out complex ion manipulations which facilitate fundamentally new performance characteristics of the FT ion trap, as will be described in detail below. A broadband-selective stimulation is understood to mean an excitation in a large ion resonance frequency band. By way of example, the following can apply for such a broadband-selective excitation: $(m/z)_{MAX}/(m/z)_{MIN}>5$, optionally >10, where $(m/z)_{MAX}$ denotes the maximum mass-to-charge ratio of the IFT excitation and $(m/z)_{MIN}$ denotes the minimum mass-to-charge ratio of the IFT excitation. It is understood that IFT excitations with a smaller ion resonance frequency band are also possible.

In one variant, at least one IFT excitation for selecting ions that are to be stored in the FT ion trap is carried out during the production of the ions in the FT ion trap and/or during the storage of the ions in the FT ion trap. Particularly in the case of an electric FT ion trap, it is possible that unwanted ions, which should not be stored in the FT ion trap and which lie in a predetermined interval of the mass-to-charge ratio (wherein this interval may have a plurality of non-contiguous sub-intervals), are excessively excited via a continuous SWIFT excitation already during the ionization or during the storage process, and so these ions or charge carriers are lost to the surrounding electrodes of the FT ion trap and only the ions to be stored, which have the desired mass-to-charge ratios, remain in the FT ion trap and are stored therein.

In this variant, the ions are produced in the FT ion trap, i.e. the gas to be examined is introduced into the FT ion trap in the charge-neutral state. By way of example, the ionization in the FT ion trap can be performed as described in WO 2015/003819 A1 cited at the outset, i.e. ions and/or metastable particles of an ionization gas and/or electrons can be introduced into the FT ion trap, which ionize the gas mixture or gas to be examined in the FT ion trap. It is understood that, in principle, it is also possible to ionize the ions outside of the FT ion trap and supply the gas to be examined in the form of gas ions to the FT ion trap. In this case, too, there can be a selection of ions to be stored or of ions to be accumulated in the FT ion trap during the storage of the ions in the FT ion trap.

In a development of this variant, only ions whose mass-to-charge ratio lies outside of an interval of the mass-to-charge ratios of a main gas component of the gas to be examined are selected for storage or accumulation. Within the meaning of this application, a main gas component is understood to mean a gas constituent, the volume fraction of which lies at more than 50% by volume, in many applications at more than 90% by volume, of the gas to be examined. Typically, the main gas component is only a single gas constituent, e.g. $N_2$ or $H_2$, i.e. a single substance which, as a rule, corresponds to only one mass-to-charge ratio in the mass spectrum. Optionally, the main gas component, whose volume fraction lies at more than 50% by volume, optionally at more than 90% by volume, may also be composed of a plurality of gas constituents. In this case, each of the gas constituents of the main gas component has more than 20% by volume or, optionally, more than 30% by volume of the gas to be examined.

In many applications, gas traces or gas components with very low partial pressures or concentrations are detected in a gas matrix of a gas to be examined, for example a process gas, with a high overall pressure. The ratio of these partial pressures to the overall pressure is, for example, of the order of ppm volume ($10^{-6}$ ppmV) to pptV ($10^{-12}$) per volume. By way of the SWIFT excitation described further above, the main gas component or main gas components of the gas to be examined can be filtered such that only the ions of the gas traces or gas components of interest are stored in accumulating fashion in the FT ion trap for the subsequent detection. In this way, care is already taken during the ionization time of the gas trace ions to be measured that the FT ion trap is not flooded by the charge carriers of the main gas components. As a result, a dynamic range D more than eight, or possibly more than nine, orders of magnitude ($D>10^8$ or $10^9$) can be obtained in the subsequent measurement. Additionally, the sensitivity (absolute concentration) of the FT ion trap and, accordingly, the signal-to-noise ratio SNR increase with the accumulation time. As a result, the detection limit for individual gas components may be of the order of $10^{-16}$ mbar or less. The dynamic range of the (electric) FT ion trap for this detection lies above the capability of conventional residual gas mass spectrometers.

In a further variant, the degree of excitation and/or the phase angle of the IFT excitation are varied between a first excitation frequency and a second excitation frequency, wherein both the first excitation frequency and the second excitation frequency deviate from a predetermined excitation frequency by no more than 10%, preferably by no more than 5%, in particular by no more than 1%. The degree of excitation denotes the amplitude of the IFT excitation in relation to a predetermined maximum amplitude and is typically specified in percent.

When detecting ions in the (electric) FT ion trap, the assumption is made that the high-frequency alternating field E acts on the ions alone. In practical terms, this applies as long as only a restricted number of charge carriers with the same sign are present in the FT ion trap. The overall number of charge carriers is referred to as "space charge" or "ion cloud". The potential $\Phi(E=-\mathrm{grad}(\Phi))$ that is describable by way of Laplace's equation and that is derived from the high-frequency alternating field E is influenced by the space charge. This influence on the storage potential by the space charge in a given volume within the FT ion trap increases with increasing space charge density $\rho$ in this volume and with decreasing mean restoration force in the associated partial volume that arises from the high-frequency alternating field. This follows from Laplace's equation (1) for the high-frequency alternating field:

$$\mathrm{div}(\mathrm{grad}(\Phi))=\Delta\Phi=-\rho/\varepsilon_0 \quad (1),$$

where $\varepsilon_0$ denotes the vacuum permittivity and $\Phi$ denotes the high-frequency alternating potential associated with the alternating field E (see above).

Particularly when exciting different ion types that have ion resonance frequencies that are close together, what may emerge from the synchronous oscillation of the ion packets is that, in places, large space charge densities arise in "space charge susceptible" regions in the FT ion trap, as a result of which whole ion packets may be strongly interfered with in terms of their resonance frequencies or the whole ion packets even can no longer be stored anymore. As a result, this may yield a large variation in the measured ion resonance frequencies, having a significantly lower mass resolution as a consequence.

Therefore, it was found to be advantageous if the charge carrier packets or ions (ion populations) with adjacent ion resonance frequencies do not simultaneously travel along the same path of motion (orbit). What can be achieved as a result of suitable orbital (orbit-derived), phase-offset IFT excitations of the ions (e.g. a slight orbital pulling apart of the ion packets by suitable SWIFT excitation) is that a sufficiently low space charge density predominantly emerges during the measurement or detection. Alternatively, or additionally, there can be a change in the degree of excitation or amplitude of the SWIFT excitation, which may likewise lead to the interaction between adjacent ion populations strongly decreasing or which allows the latter to move on different paths of motion or orbits.

Here, the variation of the phase angle and/or the degree of excitation of the SWIFT excitation occurs in a contiguous interval between a first excitation frequency $f_{ion,1}$ and a second excitation frequency $f_{ion,2}$ ($f_{ion,1}<f_{ion,2}$), wherein both lie comparatively close to one another, i.e. both the first and the second (ion) excitation frequency deviate upwardly or downwardly by no more than 10% or 5%, in particular by no more than 1%, from a predetermined excitation frequency $f_{ion,a}$, i.e. the following applies: $f_{ion,1}\geq 0.9\ f_{ion,a}$ and $f_{ion,2}\leq 1{,}1\ f_{ion,a}$ or, accordingly $f_{ion,1}\geq 0.95\ f_{ion,a}$ and $f_{ion,2}\leq 1.05\ f_{ion,a}$, or $f_{ion,1}\geq 0.99\ f_{ion,a}$ and $f_{ion,2}\leq 1.01\ f_{ion,a}$. Typically, the predetermined excitation frequency $f_{ion,a}$ corresponds to the mass-to-charge ratio of the ion population or ions of interest. As a result of the variation in the phase angle and/or in the degree of excitation, which is described further above, ion populations that are present within this interval can be brought to different orbits, as a result of which the mass resolution increases when examining the ion population(s) of interest.

In a further variant, the phase angle and/or the degree of excitation vary in steps between the first excitation frequency and the second excitation frequency, depending on the excitation frequency. The frequency width of the steps can be selected to be of equal size in particular, i.e. the interval between the first excitation frequency and the second excitation frequency is subdivided into sub-intervals or steps of equal size, between which the phase angle and/or the degree of excitation can be modified. However, it is understood that the frequency width of the partial intervals need not necessarily be selected to have the same size. Ideally, there is a change in the degree of excitation and/or in the phase angle at the transition between respectively two adjacent sub-intervals in each case in order to steer the ions that are assigned to the adjacent sub-intervals into different orbits.

In a development, the degree of excitation and/or the phase angle either increase in steps or decrease in steps between the first excitation frequency and the second excitation frequency, depending on the excitation frequency. In this way, the ions that are assigned to adjacent sub-intervals can be distributed among different orbits in a particularly simple manner. The increase or decrease in the degree of excitation and/or the phase angle between adjacent steps or sub-intervals can be the same size in each case; however, it is also possible to select the increase or the decrease of the degree of excitation between adjacent sub-intervals to be different in each case or to vary these.

The ion packets or the ions with adjacent mass-to-charge ratios are excited by a short-term action on the ion packets via a short-term excitation pulse in the corresponding ion resonance band. If the ions in the different ion resonance bands are excited with different amplitudes and phases, it is possible either to strongly minimize the interaction between the ion packets, as is illustrated further above, or to deliberately amplify the interaction. Such a deliberate amplification of the interactions between the ion populations may also be found to be advantageous in certain circumstances. In any case, the interactions between the ion populations can be influenced in an adaptive manner by way of the above-described SWIFT excitation.

In a further variant, the same ions are repeatedly selectively excited (optionally broadband-selectively excited) in the FT ion trap by IFT excitations, wherein a detection of the ions is carried out after a respective IFT excitation. During the detection after a respective IFT excitation, the number of excited ions (or the partial pressure of the excited gas constituent) is determined. By forming a mean over the number of ions determined during the detections in each case, it is possible to significantly increase the signal-to-noise ratio (SNR) of the excited ions of interest, without the remaining ions being influenced by the excitation. Particularly in the case of very low partial pressures (e.g. in the pptV range or lower) of gas traces or gas constituents of interest, an additional SNR gain of 10*log10(N) in dB is possible and advantageous (N describes the number of the multiple IFT excitations of the same ion population). Here, the assumption is made that the ions can be stored in a stable fashion over the entire measurement duration and the ions maintain their characteristic, chemical properties.

In a development, there is a time interval between two IFT excitations that immediately follow one another in time, the time interval being greater than a mean free time of flight of the ions in the FT ion trap. The mean free time of flight $t_M$ is linked to the mean free path length $L_M$ by the mean speed $v_M$, with the following applying: $t_M=L_M/v_M$. Typically, the mean free time of flight $t_M$ lies at more than approximately 1 ms (>1 ms). The IFT excitations, in particular the SWIFT excitations, are only repeated once the ions have traversed a multiple of the mean free time of flight, for example more than $3\times t_M$ more than $5\times t_M$ or more than $10\times t_M$.

There can be chemical reactions, such as e.g. a charge transfer or "protonation", after the ionization as a result of collisions between the neutral gas parts and the ionized gas particles, the chemical reactions modifying the original ion populations. It is of interest in many applications to find out about the chemical intermediate products of such a process.

Therefore, in one variant, there is an examination of an ion signal by mass spectrometry only in a temporally displaceable measurement time interval when detecting the ions. After the IFT excitation, in particular after the SWIFT excitation, the mass spectrum that changes in time can be calculated and presented via a suitably selected, displaceable, short measurement time interval, which is also referred to as FFT time window below. The measurement time interval that can be displaced in time can have a time duration of the order of, for example, a plurality of milliseconds, preferably of 10 ms or less, particularly preferably of 5 ms or less. A temporal representation of the chemical behavior of the ion population that is embedded in the gas matrix or in the gas to be examined emerges by a continuous or discrete displacement of the FFT time window.

A large mass range and a very high mass resolution is involved for the purposes of analyzing complex analytes that consist of a multiplicity of different molecules, the molecular masses of which lie partly far apart and partly close together. In order to meet this, different mass analysis methods, as a rule, are combined with one another, e.g. two mass analysis methods (so-called MS/MS) or, more generally, n mass analysis methods (so-called MS″). Typically, quadrupole mass spectrometers or conventional iron traps are used for filtering or fragmenting in the mass region of interest and the selected mass region is subsequently analyzed more finely using a different high-resolution mass analyzer (e.g. Fourier-transform-based, location-based or time-of-flight-based methods) in order to prevent overdriving of the analyzers (see space charge problem) and simplify the subsequent analysis.

From the procedure described above, it becomes clear that the underlying FT ion trap is very well suited to being both a fragmenting or filtering device and a high-resolution mass analyzer. Here, it was found to be advantageous only to quickly switch over the mass regions of interest by IFT or SWIFT excitation and significantly increase the mass resolution using the measures described above.

As described further above, the mass-to-charge ratios of ions are measured in a non-reactive manner in FT mass spectrometers by way of a Fourier transform on the basis of their characteristic oscillations or ion resonance frequencies. As a rule, the mirror charge currents arising here are only a few fA ($10^{-15}$ A). The ion resonance frequencies typically lie at the order of kHz to MHz, e.g. from approximately 1 kHz up to 200 kHz, and therefore can be superposed by parasitic interference frequencies which may generate so-called "phantom masses". Although the systematic interference frequencies, i.e. those known to the measurement system, can be removed via suitable measures, parasitic external interference frequencies, which are usually unknown to the measurement system, may lead to an incorrect interpretation of the mass spectra.

A further aspect relates to a method of the type set forth at the outset, in particular to a method as described further above, the method including the following steps: exciting the ions in the FT ion trap and recording a first frequency spectrum of the ions, modifying the phase angle and/or the oscillation amplitude of the ions in the FT ion trap and/or modifying the ion resonance frequencies of the ions in the FT ion trap, exciting the ions in the FT ion trap again and recording a second frequency spectrum of the ions, and detecting interference frequencies in the FT ion trap by comparing the first recorded frequency spectrum and the second recorded frequency spectrum. Changing the phase angle and/or the oscillation amplitude of the ions in the FT ion trap can be effectuated, in particular, during the renewed excitation of the ions in the FT ion trap by an IFT excitation, specifically by a SWIFT excitation.

With the aid of the method described here, interference frequencies can be unambiguously identified and optionally be eliminated from the regions of interest of the ion resonance frequencies. What is exploited here is that only the ions that are stored in the FT ion trap react to the IFT excitation or to the change in the ion resonance frequencies. The remaining frequency components present in the frequency spectrum which cannot be influenced at all in this way can be identified as interference frequencies. The mass-to charge ratios that are identified as interference frequencies can be filtered or eliminated from the mass spectrum which corresponds to the frequency spectrum.

In the case of the IFT excitation, the phase angle and/or the oscillation amplitude of the ions of interest can be influenced virtually arbitrarily, wherein care should be taken that the ions are not removed from the FT ion trap in the process. By way of example, the amplitude and/or the phase angle of the ions stored in the FT ion trap can be modified in such a way that the height of the associated lines in the mass spectrum or in the frequency spectrum changes, while the lines of the interference frequencies do not change in the case of such action.

In a development, modifying the ion resonance frequencies includes modifying a storage voltage and/or a storage frequency of the FT ion trap. As mentioned further above, in order to measure the mass-to-charge ratio of the ions, the latter are excited by an excitation signal (stimulus) to carry out oscillations, the resonance frequencies of which are dependent on the ion masses and the charges of the ions, wherein the ion resonance frequencies typically lie in the frequency range at orders of kHz to MHz, e.g. from approximately 1 kHz to 200 kHz. In the case of a predetermined mass-to-charge ratio, a respective ion resonance frequency is directly proportional to the high-frequency storage voltage $V_{RF}$ and inversely proportional to the square of the storage frequency $f_{RF}$ of the high-frequency alternating field, and so this behavior can be used to displace the ion resonance frequencies (also referred to as frequency SHIFT below).

By way of example, the ion resonance frequencies can be increased by increasing the high-frequency storage voltage $V_{RF}$ and, conversely, the ion resonance frequencies can be reduced by reducing the high-frequency storage voltage $V_{RF}$. The ion resonance frequencies behave in an inverted manner in relation thereto in the case of a variation of the storage frequency $f_{RF}$.

In a further variant, the method includes the following step: determining a start phase angle of a trajectory of ions at a given ion resonance frequency (immediately) after an IFT excitation on the basis of a time-dependent ion signal recorded when detecting. In order to determine the start phase angle of the movement along a trajectory of ions or of an ion type at the predetermined ion resonance frequency, it is possible, after the excitation, to record the time-dependent ion signal $u_{ion}(t)$ in a sufficiently long measurement time window $T_0$ in order to avoid a discretization error and the ion resonance frequencies $f_{ion}$ of the ions can be obtained via Fourier analysis, wherein the following applies: $T_0 >> 1/f_{ion}$ and $T_0 \times 1/f_{ion}$ and $N_o$ integer>>1. The measurement time window $T_0$ is typically less than approximately 1/10 or 1/50 of the entire measurement or detection duration, and so the amplitude $\hat{u}_{ion}$ of the envelope of the (oscillating) ion signal $u_{ion}(t)$ remains approximately constant in the measurement time window $T_0$.

In this case, the start phase angle $\alpha_0$ of the movement along a trajectory at the start of the measurement or of the measurement time interval can be determined according to the following formula:

The following emerges from $$\frac{1}{2}\cos(\alpha_0) = \left[\frac{1}{T_0 * \hat{u}_{ion}} \int_0^{T_0} u_{ion}(t) * \cos(2\pi f_{ion} * t + \varphi) dt\right]; \tag{2}$$

$$\alpha_0 = \cos^{-1}\left(2 * \frac{1}{T_0 * \hat{u}_{ion}} \int_0^{T_0} u_{ion}(t) * \cos(2\pi f_{ion} * t + \varphi) dt\right),$$

where $\varphi$ denotes a start phase of the IFT excitation of the ions at the ion resonance frequency $f_{ion}$ and where $\hat{u}_{ion}$ denotes the maximum of the absolute value of the amplitude or of the envelope of the (oscillating) ion signal $u_{ion}(t)$ at the start of the measurement (t=0). The expression placed between square brackets in (2) only has a maximum absolute value if the start phase $\varphi$ of the IFT excitation corresponds to the start phase angle $\alpha_0$ of the movement along a trajectory apart from $k*\pi(\varphi=\alpha_0+k*\pi$, k integer). In this case, the value of the expression between the square brackets corresponds to ½ cos ($\alpha_0$). Consequently, the value of the expression between square brackets is approximately +½ for a start phase $\varphi=0°$ of the IFT excitation and the value of the expression between square brackets is approximately −½ for a start phase $\varphi=180°$ of the IFT excitation. As was described further above, the start phase $\varphi$ may be varied depending on the ion resonance frequency in the case of a mass-dependent phase-shifted orbital IFT excitation. In this way, ion packets in the mass spectrum can be accordingly marked differently. If the start phase $\varphi$ of the IFT excitation is unknown, the latter, and hence the start phase angle $\alpha_0$ of the movement along a trajectory, can be determined by maximizing the absolute value of the expression specified within square brackets.

In a development, the method additionally includes the following step: determining a charge polarity of the ions on the basis of the start phase angle of the trajectory of the ions after the IFT excitation. In an electric FT ion trap, it is possible to capture both positively charged and negatively charged ion types at the same time. By evaluating the start phase angle $\alpha_0$ of the ion movement or the trajectory of the ions after the IFT excitation (e.g. a SWIFT excitation), more precisely by evaluating the expression ½ cos ($\alpha_0$), it is possible to detect the polarity of the ions: if the ions are stimulated by a uniform broadband excitation, e.g. the positively charged ions move toward one of the electrodes immediately after the excitation while the negatively charged ions move away therefrom. All ions are detected after excitation, independently of the polarity thereof. If the following formula is applied for each ion resonance frequency $f_{ion}$ of an associated ion type $$\text{polarity} = \text{sign}\left[\frac{1}{T_0 * \hat{u}_{ion}} \int_0^{T_0} u_{ion}(t) * \cos(2\pi f_{ion} * t + \varphi) dt\right], \tag{3}$$

the formula emerging directly from formula (2), it is possible to determine the polarity (+ or −) of the associated ion type.

If the charge polarity of the ions is known, it is possible to excite ion populations differently depending on their polarity, for example by a SWIFT-selective (optionally broadband-selective) excitation; this is effectuated by virtue of different excitation transients being applied to the measurement electrodes depending on the charge polarity. It is understood that the procedure described above is not restricted to the electrode geometry of the underlying FT ion trap, i.e. this method can be applied to measurement electrodes with different electrode geometries, for example to measurement electrodes in the form of measurement tips in the end caps or in the form of toroidal measurement caps of a toroidal ion trap, etc.

A further aspect of the disclosure relates to a mass spectrometer of the type set forth at the outset, in which the excitation device is embodied to produce at least one selective IFT excitation that is dependent on the mass-to-charge ratio of the ions, in particular a SWIFT excitation, during the storage and/or during the excitation of ions. The mass spectrometer described here is particularly suitable for carrying out the methods described further above.

It was found to be advantageous if the FT ion trap is embodied as an electric FT ion trap, i.e. the mass spectrometer is an electric ion resonance mass analyzer, in which the ions are dynamically stored by a high-frequency alternating field.

In a development, the mass spectrometer is embodied to ionize in the FT ion trap a gas to be examined, wherein the evaluation device is preferably embodied to produce an IFT excitation, in particular a SWIFT excitation, during the ionization (and during the storage). To this end, the mass spectrometer can have a device for supplying electrons and/or an ionization gas into the FT ion trap. As was described further above in conjunction with the method, a selection of ions which should be stored (in accumulating fashion) in the FT ion trap already can be undertaken during the ionization in this way, as a result of which the dynamic range and the sensitivity of the FT ion trap can be increased.

In a further embodiment, the excitation device is embodied to vary the degree of excitation (or the amplitude) and/or the phase angle of the IFT excitation between a first excitation frequency and a second excitation frequency, wherein, preferably, both the first excitation frequency and the second excitation frequency deviate from a predetermined excitation frequency by no more than 10%, particularly preferably by no more than 5%, in particular by no more than 1%. As was described further above, the mass resolution can be increased in this embodiment by virtue of ions or ion populations with mass-to-charge ratios that lie close together being able to be suitably excited in orbital fashion and in a targeted manner such that these do not run along the same trajectories.

In a development of this embodiment, the excitation device is embodied to vary the phase angle and/or the degree of excitation in steps between the first excitation frequency and the second excitation frequency, depending on the excitation frequency, wherein, preferably, the degree of excitation and/or the phase angle either increase in steps or decrease in steps between the first excitation frequency and the second excitation frequency, depending on the excitation frequency. As a result of the stepwise, in particular continuous increasing or continuous decreasing, change in the degree of excitation or the phase angle, it is possible to obtain a sufficient spacing of the orbits, a low local space charge density during the measurement and hence a higher mass resolution.

In a further embodiment, the mass spectrometer includes a detector which is embodied to determine a phase angle of a trajectory of ions with a given ion resonance frequency on the basis of a time-dependent ion signal recorded when detecting the ions after an IFT excitation, wherein the detector is preferably embodied to determine a charge polarity of the detected ions on the basis of the phase angle. As was described further above, the charge polarity of the ions can be detected by an evaluation of the phase angle of the ion movement after the IFT excitation A further aspect of the disclosure relates to a mass spectrometer of the type set forth at the outset, in particular as described further above, in which the excitation device is embodied to modify a phase angle and/or an oscillation amplitude of the ions in the FT ion trap and/or ion resonance frequencies of the ions in the FT ion trap, wherein the mass spectrometer additionally has a detector that is embodied to detect interference frequencies in the FT ion trap on the basis of a comparison of a first frequency spectrum that was recorded before modifying the phase angle and/or the oscillation amplitude of the ions in the FT ion trap and/or modifying the ion resonance frequencies of the ions in the FT ion trap with a second frequency spectrum that was recorded after modifying the phase angle and/or the oscillation amplitude of the ions in the FT ion trap and/or modifying the ion resonance frequencies of the ions in the FT ion trap. As was described further above, interference frequencies in the recorded spectra can be identified by virtue of these not reacting, or only reacting slightly, to the modification of the ion resonance frequencies or to the modification of the phase angle and/or the oscillation amplitude of the ions.

In a further embodiment, the FT ion trap is embodied as FT-ICR ion trap or as an Orbitrap. As a matter of principle, mass spectrometry via a Fourier transform can be carried out with different types of FT ion traps for carrying out fast measurements, wherein the combination with the so-called ion cyclotron resonance trap (FT-ICR ion trap) is the most widespread. Mass spectrometry is carried out via a cyclotron resonance excitation in the FT-ICR trap, which may be embodied as a magnetic or electric ICR trap. The so-called Orbitrap has a central, spindle-shaped electrode, around which the ions are kept in orbits by electric attraction, wherein an oscillation along the axis of the central electrode is produced by a decentral injection of the ions, the oscillation producing signals in the detector plates which can be detected in a similar fashion to the FT-ICR trap (by FT). It is understood that the mass spectrometer can also be operated in combination with other types of FT ion traps, i.e. with ion traps in which an induction current that is generated on the measurement electrodes by the stored ions is detected and amplified in a time-dependent manner.

Further features and advantages of the disclosure emerge from the following description of exemplary embodiments of the disclosure, with reference to the figures of the drawing, which show certain details essential of the disclosure, and from the claims. The individual features may be realized in each case individually by themselves or as a plurality in any desired combination in a variant of the disclosure.

BRIEF DESCRIPTION OF THE DRAWINGS

Exemplary embodiments are illustrated in the schematic drawing and are explained in the following description. In the drawings.

DETAILED DESCRIPTION

In the following description of the drawings, identical reference signs are used for identical or functionally identical components.

Figure 1:
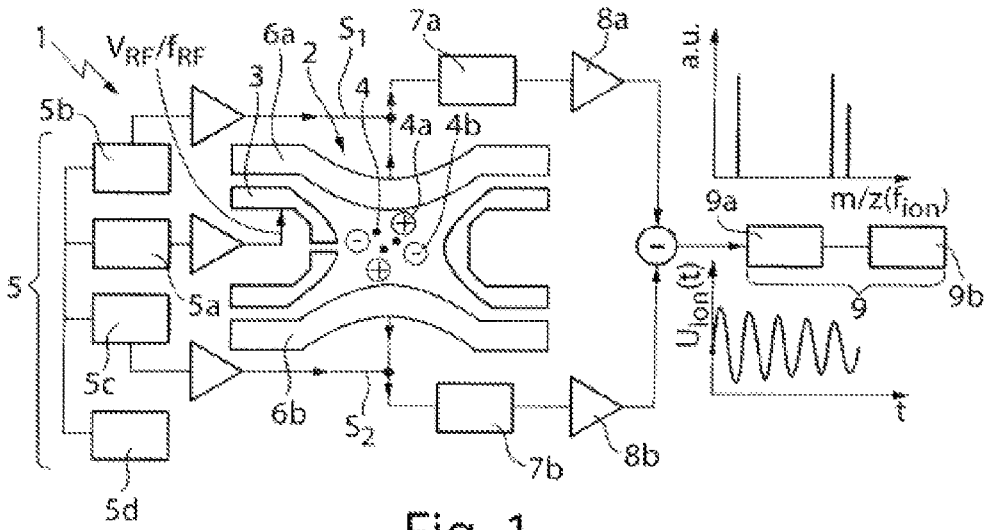
FIG. 1 shows a schematic illustration of a mass spectrometer with an electric FT-ICR ion trap.

FIG. 1 schematically shows a mass spectrometer 1 which has an electric FT-ICR ion trap 2. The FT-ICR trap 2 has a ring electrode 3, which has applied thereto a high-frequency AC voltage $V_{RF}$ which, for example, can have a frequency $f_{RF}$ of the order of kHz to MHz, e.g. 1 MHz, and an amplitude $V_{RF}$ of several hundred volts. The high-frequency AC voltage $V_{RF}$ produces a high frequency alternating field within the FT-ICR trap 2, ions 4*a*, 4*b* of a gas 4 to be examined being dynamically stored in the field.

From the high-frequency alternating field (E-field), there results a mean restoring force that acts on the ions 4*a*, 4*b* more strongly, the further away the ions 4*a*, 4*b* are from the middle or center of the FT-ICR ion trap 2. In order to measure the mass-to-charge ratio (m/z) of the ions 4*a*, 4*b*, the latter are excited by an excitation signal S1, S2 (stimulus) to carry out oscillations, the frequency $f_{ion}$ of which is dependent on the ion mass and the ion charge and is typically in the frequency range of kHz to MHz orders of magnitude, e.g. from approximately 1 kHz to 200 kHz. The respective excitation signal S1, S2 is produced by a second excitation unit 5*b* and a third excitation unit 5*c* which forms an excitation device 5 together with a first excitation unit 5*a*, which serves to produce the high-frequency storage voltage $V_{RF}$ with the predetermined storage frequency $f_{RF}$. The excitation device 5 also has a synchronization device 5*d*, which synchronizes the three excitation units 5*a-c* in time. An amplifier is disposed downstream of each excitation unit 5*a-c*, the amplifiers likewise being part of the excitation device 5.

For the purposes of a non-reactive, non-destructive detection (i.e. the ions 4*a*, 4*b* are still present after the detection), the oscillation signals of the ions 4*a*, 4*b* are tapped in the form of induced mirror charges at the measurement electrodes 6*a*, 6*b*, as described e.g. in DE 10 2013 208 959 A which was cited at the outset, the entirety of the latter being incorporated into the content of this application by reference. As described in detail therein, the respective measurement electrodes 6*a*, 6*b* are respectively connected to a low-noise charge amplifier 8*a*, 8*b*, respectively by way of a filter 7*a*, 7*b*. The charge amplifiers 8*a*, 8*b*, firstly, capture and amplify the ion signals from the two measurement electrodes 6*a*, 6*b* and, secondly, keep the measurement electrodes 6*a*, 6*b* at virtual ground potential for the storage frequency $f_{RF}$. From the signals supplied by the charge amplifiers 8*a*, 8*b*, an ion signal $u_{ion}(t)$ is produced via difference formation, the temporal profile of the ion signal being illustrated at the bottom right in FIG. 1. The ion signal $u_{ion}(t)$ is fed to a detector 9, which, in the example shown, has an analog-to-digital converter 9*a* and a spectrometer 9*b* for fast Fourier analysis (FFT) in order to produce a mass spectrum, which is illustrated at the top right in FIG. 1. In this case, the detector 9 or the spectrometer 9*b* firstly produce a frequency spectrum of the characteristic ion resonance frequencies $f_{ion}$ of the ions 4*a*, 4*b* stored in the FT-ICR ion trap 2, which frequency spectrum is converted into a mass spectrum on the basis of the dependence of the ion resonance frequencies $f_{ion}$ on the mass and charge of the respective ions 4*a*, 4*b*. The mass spectrum represents the number of detected particles or charges as a function of the mass-to-charge ratio m/z.

As a consequence, the electric FT-ICR trap 2 facilitates a direct detection or the direct recording of a mass spectrum, as a result of which a quick gas analysis is facilitated. However, the fast recording of a mass spectrum with the aid of Fourier spectrometry can be effectuated not only in the electric FT-ICR trap 10 described above, but also in variations of the trap type shown in FIG. 1, for example in the case of a so-called Orbitrap.

As was described further above, all ions 4*a*, 4*b* in the FT-ICR ion trap 2 have an ion resonance frequency Con with which the stored ions 4*a*, 4*b* oscillate in the FT-ICR ion trap 2, the ion resonance frequency being proportional to the mass-charge ratio (m/z) of the ions. If the ions 4*a*, 4*b* are excited at their respective ion resonance frequency $f_{ion}$, they either can be excited in a targeted manner in this way or be thrown out of the FT-ICR ion trap 2 by way of a resonance overshoot. As a consequence, ions 4*a*, 4*b* with certain mass-to-charge ratios m/z can be selectively excited or the storage thereof in the FT-ICR ion trap 2 can be prevented/suppressed.

Figure 2:
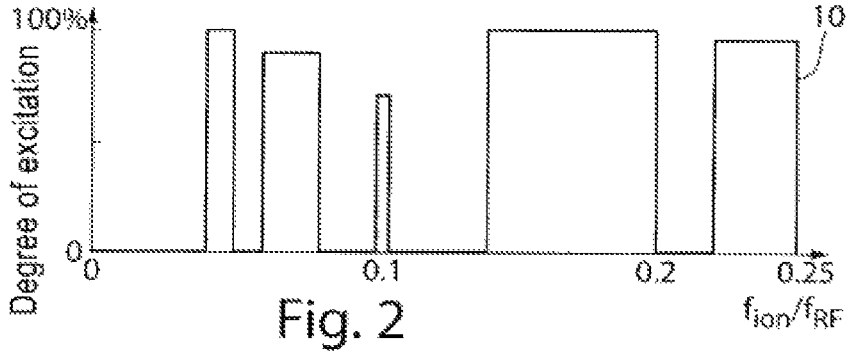
FIG. 2 shows a schematic illustration of a degree of excitation that is dependent on the ion resonance frequency during a SWIFT excitation.

The generalization of this principle leads to one or more regions ("windows") in the ion resonance frequency range, in which ions 4*a*, 4*b* whose ion resonance frequency $f_{ion}$ lies within the respective window can be excited or suppressed in a targeted manner. The inverse transformation of these regions by way of an inverse Fourier transform supplies the time signal for the so-called IFT excitation. This is referred to as a SWIFT excitation 10 if these time profiles are calculated in advance. An example of SWIFT excitation 10 with a broadband-selective excitation spectrum is depicted in FIG. 2, wherein the ion resonance frequencies $f_{ion}$ are related to the storage frequency $f_{RF}$. The desired selective excitation spectrum depends on the ion resonance frequencies $f_{ion}$ and, as a consequence, on the mass-to-charge ratio (m/z) of the ions 4*a*, 4*b*. The associated discrete SWIFT time function (not shown in FIG. 2) is output at the instant of the SWIFT excitation in order to obtain the desired excitation spectrum shown in FIG. 2.

The measurement electrodes 6*a*, 6*b* can be used for the SWIFT excitation 10. By way of the SWIFT excitation 10, the ions 4*a*, 4*b* can be deflected in the direction of the measurement electrodes 6*a*, 6*b* in such a way that certain ions 4*a*, 4*b* are firstly either stored or not stored and secondly excited practically continuously or not excited at all, both during the ion production and ion storage and also immediately before the detection of the ion signals $u_{ion}(t)$.

Therefore, a number of options emerge by way of the SWIFT excitation for realizing new performance characteristics of the mass spectrometer 1. A precondition for all measurement tasks is that the excitation time of the ions 4*a*, 4*b* within the FT-ICR ion trap 2 is substantially shorter than the mean free time of flight or the mean free path length of the molecules or ions 4*a*, 4*b* of interest. It was found to be advantageous to use optimized SWIFT algorithms, as are presented, for example, in the article "Stored Waveform Inverse Fourier Transform Axial Excitation/Ejection for Quadrupole Ion Trap Mass Spectrometry" by S. Guan and A. G. Marshall, Anal. Chem. 1993, pages 1288-1294 or in U.S. Pat. No. 4,945,234, both of which are incorporated into the content of this application by reference. Optimized SWIFT algorithms firstly produce a SWIFT signal output that is as short as possible and secondly prevent overdriving of the low-noise charge amplifiers 8*a*, 8*b* that are connected to the measurement electrodes 6*a*, 6*b*.

Figure 3:
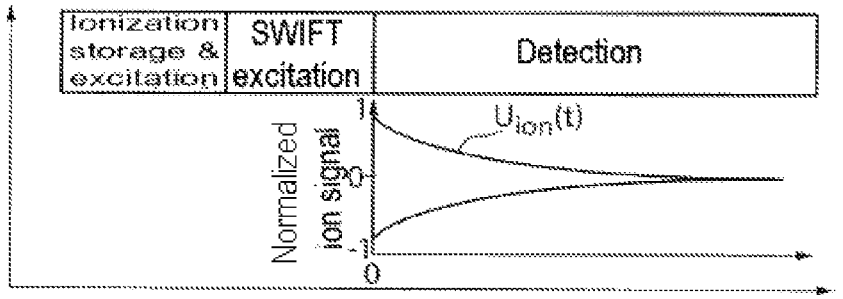
FIG. 3 shows a schematic illustration of a timing during a measurement for recording a mass spectrum with the aid of the mass spectrometer from FIG. 1.

A SWIFT excitation 10 can be effectuated immediately before the detection of the ions 4*a*, 4*b*, i.e. before recording the (normalized) ion signal, as illustrated in FIG. 3, which only shows the envelope of the (normalized) ion signal $u_{ion}(t)$. However, a SWIFT excitation 10 can also already be effectuated during the production and storage of the ions 4*a*, 4*b*, as likewise indicated by the timing in FIG. 3. In this case, the SWIFT excitation 10 serves to select ions 4*a*, 4*b* that are to be stored in the FT-ICR ion trap 2.

In principle, there are two options for producing the ions 4*a*, 4*b* by ionizing the gas 4: either the ions 4*a*, 4*b* are produced within the FT-ICR ion trap 2 or the gas 4 is supplied to the FT-ICR ion trap 2 in a charge-neutral form and the ionization is effectuated in the FT-ICR ion trap 2. By way of example, such an ionization in the FT-ICR ion trap 2 can be carried out in the way described in WO 2015/003819 A1, which is cited at the outset and incorporated into the content of this application in respect of this aspect by reference.

If the ionization is effectuated in the electric FT-ICR ion trap 2, a continuous SWIFT excitation can already be effectuated during the ionization of the gas 4 (cf. FIG. 3), as a result of which unwanted gas components are excessively excited; as a result, the charge carriers of the unwanted gas components are lost at the surrounding electrodes 3, 6*a*, 6*b* and only the charge carriers or ions 4*a*, 4*b* of interest are stored in accumulating fashion in the FT-ICR ion trap 2 for measurement purposes; as a result, this ensures that the FT-ICR ion trap 2 is not flooded by the unwanted charge carriers during the ionization time of the ions 4*a*, 4*b* to be detected. The ions 4*a*, 4*b* to be analyzed or to be detected are stored and accumulated in the FT-ICR ion trap 2 immediately after the ionization or after the transfer into the FT-ICR ion trap 2.

Figure 4:
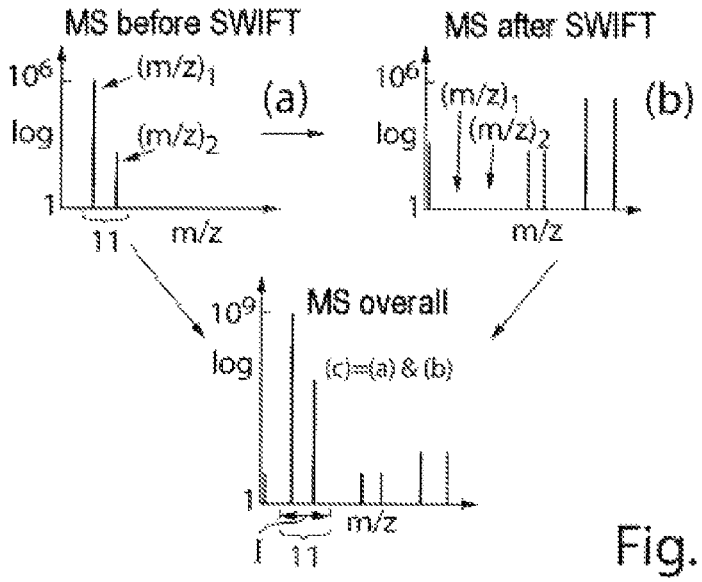
FIG. 4 shows schematic illustrations of three mass spectra of a gas with a main gas component.

Such a selection during or before storage is advantageous since many applications involve the detection of gas traces or gas components with very low partial pressures or concentrations in a gas matrix or a gas 4 with a high overall pressure. An example of a mass spectrum of such a gas is illustrated at the bottom of FIG. 4. If gas traces with very low partial pressures, the mass spectrum of which is illustrated top right in FIG. 4, should be detected, the unwanted gas components that should not be stored in the FT-ICR ion trap 2 may be a main gas component 11 of the gas 2 to be examined. Within the meaning of this application, a main gas component 11 is understood to mean a gas constituent, the volume fraction of which lies at more than 50% by volume, in many applications at more than 90% by volume, of the gas 2 to be examined.

In the example shown in FIG. 4, the main gas component 11 has two ion populations with different mass-to-charge ratio $(m/z)_1$ and $(m/z)_2$, the volume fraction of which lies at more than 30% by volume of the gas 2 to be examined in each case such that the overall volume fraction of the main gas component 11 lies at more than 50% by volume of the gas 2 to be examined. The mass spectrum of the gas 4 recorded by the mass spectrometer 1 without a mass-selective SWIFT excitation is illustrated top left in FIG. 4. In the mass spectrum presented there, it is only possible to identify the ion populations of the main gas component 11, for example of a majority carrier gas, but not the gas traces actually of interest, the mass-to charge ratios of which lie outside of an interval I illustrated in FIG. 4, in which the mass-to-charge ratios $(m/z)_1$ and $(m/z)_2$ of the main gas component 11 are contained.

As a result of the broadband-selective SWIFT excitation 10, there can be selective filtering of those mass-to-charge ratios m/z which lie within the interval I or there can be targeted filtering of the first mass-to-charge ratio $(m/z)_1$ and of the second mass-to-charge ratio $(m/z)_2$ of the main gas component 11. In this way, only the ions 4*a*, 4*b* whose mass-to-charge ratios m/z lie outside of the interval I are stored in the FT-ICR ion trap 2, and so these can be detected with a high accuracy, as may be identified on the basis of the mass spectrum top right in FIG. 4.

The ratio of the partial pressures of the gas constituents of interest to the overall pressure may be, for example, of the orders of ppm volume ($10^{-6}$ ppmV) to pptV ($10^{-12}$). Here, the detection limit for individual gas components may be of the order of $10^{-16}$ mbar. In this way, a dynamic range D of more than eight orders of magnitude ($D>10^8$) can be achieved. Additionally, the sensitivity (absolute concentration) of the ions 4*a*, 4*b* in the FT-ICR ion trap 2 and, accordingly, the signal-to-noise ratio SNR increases with the accumulation time during the storage.

In the case of an electric FT-ICR ion trap 2, the high-frequency alternating field (E-field) is influenced by the space charge, more precisely by the space charge density, in the FT-ICR ion trap 2, i.e. there is feedback of the charges or ions 4*a*, 4*b* present in the FT-ICR ion trap 2 on the high-frequency alternating field that serves to store the ions 4*a*, 4*b*. The alternating field E is influenced more strongly the greater the space charge density is in the respective partial volume of the FT-ICR ion trap 2 and the weaker the mean restoring force arising from the high-frequency alternating field E is in the associated partial volume.

Particularly when exciting ions 4*a*, 4*b* with different but close together ion resonance frequencies or mass-to-charge ratios, high space charge densities may arise in parts of regions of the FT-ICR ion trap 2 which are particularly susceptible to the occurrence of large space charge densities. The ion resonance frequencies of whole ion packets can be strongly interfered with by the large space charge density, having a significant reduction in the measurement resolution as a consequence.

Figure 5A:
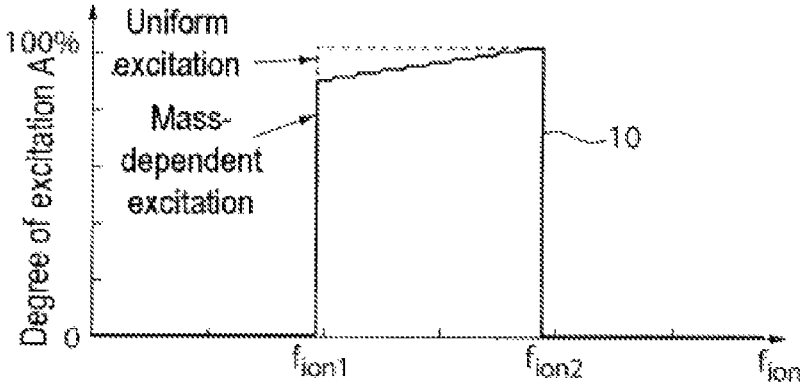
FIGS. 5*a*,5*b* show schematic illustrations of the frequency spectrum and of the time profile of a (broadband-)selective SWIFT excitation.
Figure 5B:
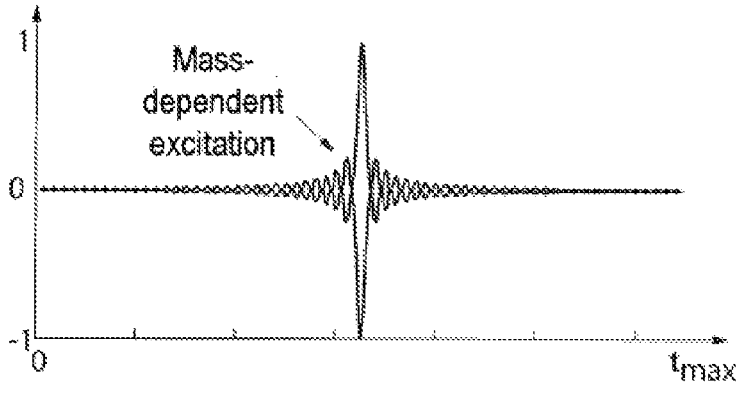

The local space charge in the FT-ICR ion trap can be reduced if ions 4*a*, 4*b* with close-together ion resonance frequencies $f_{ion}$ do not simultaneously pass over the same path of motion (or the same orbit). This can be achieved by virtue of the degree of excitation A of the SWIFT excitation 10 being varied in a frequency-dependent manner or depending on the mass or the mass-to-charge ratio m/z of the ions 4*a*, 4*b* between a first ion excitation frequency $f_{ion1}$ and a second ion excitation frequency $f_{ion2}$, as illustrated in FIG. 5*a*. FIG. 5*b* shows the associated time-dependent excitation signal (S1 and S2) of the SWIFT excitation.

In the example shown in FIGS. 5*a,b*, the degree of excitation A of the SWIFT excitation varies in steps depending on the ion excitation frequency $f_{ion}$, wherein the degree of excitation A varies by no more than approximately 20% of the maximum degree of excitation A (i.e. the maximum amplitude of the SWIFT excitation 10) over the whole interval between the first ion excitation frequency $f_{ion1}$ and the second ion excitation frequency $f_{ion2}$. In the shown example, the degree of excitation A increases in steps from the first ion excitation frequency $f_{ion1}$ to the second ion excitation frequency $f_{ion2}$, with the step height between adjacent steps of the degree of excitation A being of equal size. It is understood that, alternatively, the degree of excitation A also may decrease from the first ion excitation frequency $f_{ion1}$ to the second, higher ion excitation frequency $f_{ion2}$. Moreover, the step height, i.e. the difference between the degrees of excitation of adjacent steps of the SWIFT excitation 10, is not necessarily constant but may vary from step to step. A continuous, step-free variation of the degree of excitation A between the first ion excitation frequency $f_{ion1}$ and the second ion excitation frequency $f_{ion2}$ likewise is possible here as a matter of principle.

Figure 6A:
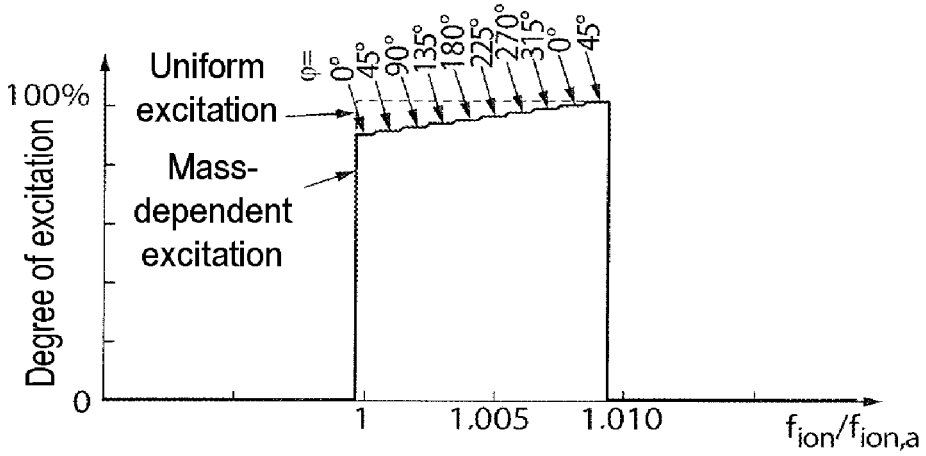
FIGS. 6*a*-6*c* show a schematic illustration of the frequency spectrum in the case of a uniform SWIFT excitation or in the case of a SWIFT excitation that varies in terms of the degree of excitation and the phase angle in a frequency-dependent manner (FIG. 6*a*) and the associated trajectories of the excited ions (FIGS. 6*b,c*)

In addition or as an alternative to varying the degree of excitation A or the amplitude of the SWIFT excitation 10, there may also be a variation of the phase angle φ of the SWIFT excitation 10, as illustrated in FIG. 6*a*. In the shown example, the phase angle φ is likewise modified step-by-step, to be precise by a value of 45° in each case, with the phase angle φ of the SWIFT excitation 10 increasing in steps with increasing ion excitation frequencies $f_{ion}$ in the example shown in FIG. 6*a*. It is understood that a step-by-step decrease in the phase angle φ of the SWIFT excitation 10 is likewise possible and that the difference between the phase angles φ of adjacent steps may deviate from 45° and, in particular, may vary from step to step. It is likewise understood that the step-by-step increase or decrease of the phase angle φ is only defined modulo 360°, i.e. a phase angle φ of 0° is attained again after eight steps in the shown example. Here, the phase angle φ corresponds to a temporal shift or retardation of the SWIFT excitation, with the phase angle φ being related to a predetermined ion excitation frequency $f_{ion,a}$.

By way of example, the predetermined ion excitation frequency $f_{ion,a}$ may correspond to the ion resonance frequency $f_{ion}$ or the mass-to-charge ratio m/z of an ion population to be analyzed. However, the predetermined ion excitation frequency $f_{ion,a}$ may also lie in an interval between two ion excitation frequencies $f_{ion1}$, $f_{ion2}$ or two associated ion resonance frequencies, the mass-to-charge ratios m/z of which lie close together. By way of example, the first (smaller) ion excitation frequency $f_{ion1}$ can deviate from the predetermined ion excitation frequency $f_{ion,a}$ by no more than 10%, preferably by no more than 5%, in particular by no more than 1%. The same applies to the second, higher ion excitation frequency $f_{ion2}$. In the example shown in FIG. 6*a*, the ratio $f_{ion1}/f_{ion,a}$ is approximately 0.999 (deviation: 0.1%) while the ratio $f_{ion2}/f_{ion,a}$ lies at approximately 1.009 (deviation: 0.9%), i.e. both ion excitation frequencies $f_{ion1}$, $f_{ion2}$ lie within the value range, described further above, of less than 1% deviation.

Figure 6B:
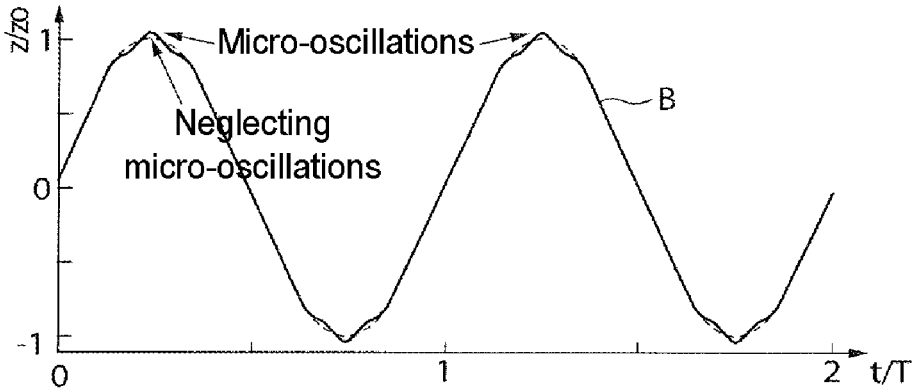

FIG. 6*b* shows the trajectory B of the ions 4*a*, 4*b* in the FT-ICR ion trap 2 in the case of a uniform SWIFT excitation, i.e. a SWIFT excitation with a constant degree of excitation A (represented by a dashed line in FIG. 6*a*) which, moreover, is effectuated in a synchronous or phase-locked manner. In FIG. 6*b*, the value z denotes the deflection of the ions 4*a*, 4*b* in the z-direction, i.e. toward the measurement electrodes 6*a*, 6*b* in the FT-ICR ion trap 2, where $z_0$ denotes the maximum deflection. The value T denotes the period duration of the oscillations of the ions 4*a*, 4*b* with the predetermined ion excitation frequency $f_{ion,a}$. What can clearly be recognized in FIG. 6*b* is that the trajectories B of the ions 4*a*, 4*b* superpose on one another such that a high space charge density arises.

Figure 6C:
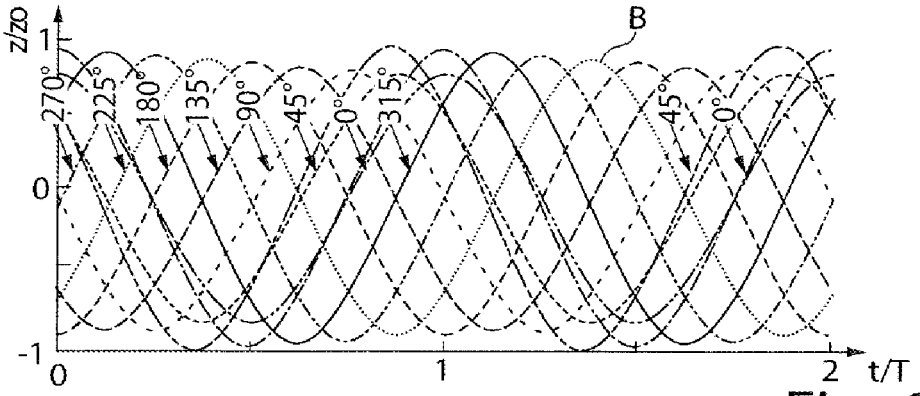

FIG. 6*c* shows the trajectories B of the ions 4*a*, 4*b* in the case of the orbital SWIFT excitation 10 illustrated in FIG. 6*a* with different degree of excitation A, in which, additionally, the phase angle φ was also varied as illustrated in FIG. 6*a*, using the example of ten ion packets or ion populations with adjacent ion resonance frequencies $f_{ion}$ or with adjacent mass-to-charge ratios m/z. What can clearly be identified in FIG. 6*c* is that the trajectories B of the ten ion packets are spatially separated by the SWIFT excitation 10, as a result of which the local space charge density in the FT-ICR ion trap 2 is reduced and the mass resolution is increased as a result thereof. Typically, the ions 4*a*, 4*b* pass over the (periodic) trajectories B more than approximately 100 times-1000 times before the measurement or detection is effectuated. In this way, only a very low pressure is involved in the FT-ICR ion trap 2 in order to carry out the measurement or detection.

Figure 7:
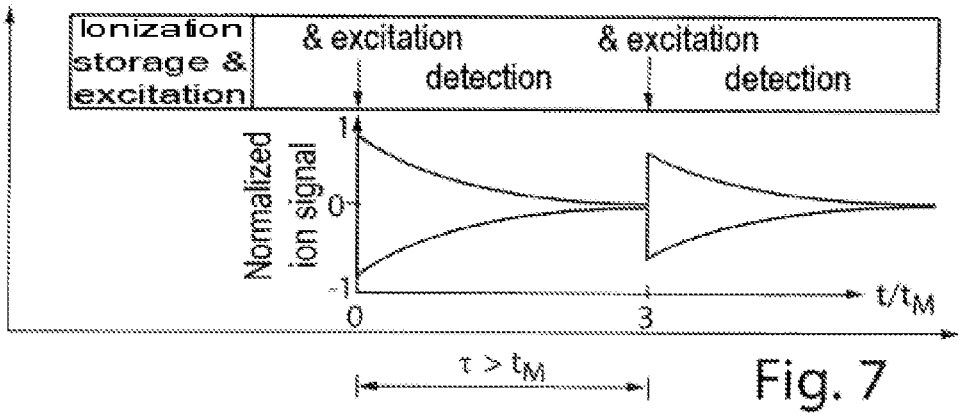
FIG. 7 shows a schematic illustration of the time profile of a multiple (broadband-) selective SWIFT excitation and a subsequent detection.

FIG. 7 shows a further application of a SWIFT excitation 10, in which the same ions 4*a*, 4*b* are successively excited in the FT-ICR ion trap 2 by two (broadband-)selective SWIFT excitations 10 and subsequently detected in each case. During the detection after a respective SWIFT excitation 10, the number of excited ions 4*a*, 4*b* (or the partial pressure of the excited gas constituent) is determined. By forming a mean over the number of ions 4*a*, 4*b* determined during the detections in each case, it is possible to significantly increase the signal-to-noise ratio (SNR) of the excited ions 4*a*, 4*b* of interest, without the remaining ions being influenced by the excitation.

The precondition for such a multiple detection is that there is a time interval τ between two IFT excitations 10 that immediately follow one another in time, the time interval being longer than a mean free time of flight $t_M$ of the ions 4*a*, 4*b* in the FT-ICR ion trap 2, i.e. $\tau > t_M$ applies, where, typically, $t_M$ lies at more than approximately one millisecond (>1 ms). The SWIFT excitations are only repeated once the ions 4*a*, 4*b* have traversed a multiple of the mean free time of flight $t_M$, for example more than $3 \times t_M$ more than $5 \times t_M$ or more than $10 \times t_M$.

Figure 8:
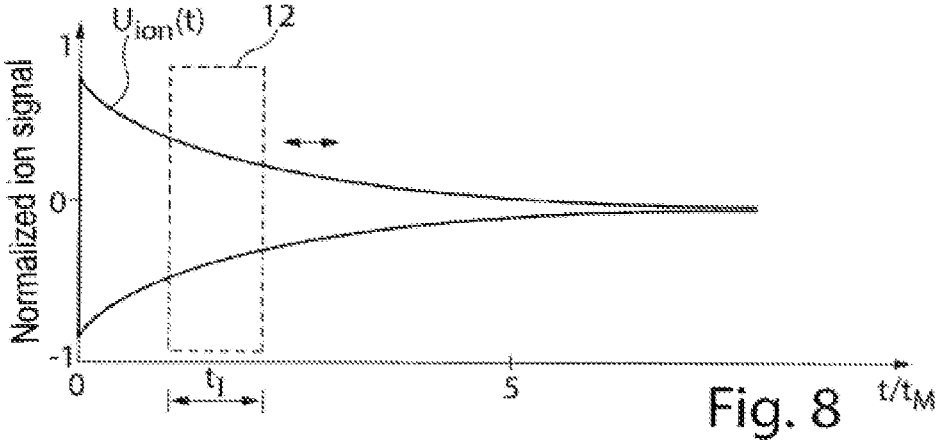
FIG. 8 shows a schematic illustration of a detected ion signal with a temporally displaceable measurement time interval.

FIG. 8 shows a time-dependent ion signal $u_{ion}(t)$ after a SWIFT excitation 10 and a temporally displaceable measurement time interval 12 (FFT time window) represented by dashed lines, the measurement time interval having a time duration ti in the order of e.g. a plurality of milliseconds, preferably of 10 ms or less, particularly preferably of 5 ms or less. A time-resolved representation of the chemical behavior of the ion population that is embedded in the gas matrix or in the gas to be examined can emerge by a continuous or discrete displacement of the measurement time interval 12. In this case, the examination by mass spectrometry is only undertaken on the basis of the values of the ion signal $u_{ion}(t)$ during the measurement time interval 12, i.e. an evaluation is carried out only in the measurement time interval 12. This is particularly advantageous if chemical reactions such as e.g. charge transfer or "protonation", which modify the originally present ion population during the detection time period, occur during the detection of the ions 4*a*, 4*b*. By carrying out the evaluation only in the measurement time interval 12 it is possible, for example, to observe a reaction such as a transition from $H_2O^+$ to $H30^+$ practically in real time, i.e. intermediate products of chemical reactions can also be detected. In particular, this renders it possible to check whether the selected ions 4*a*, 4*b* that are stored in the FT-ICR ion trap 2 in fact correspond to the ion population that is provided for the chemical reaction. Optionally, the selection or the selection process of the ions 4*a*, 4*b* that should be accumulated in the FT-ICR ion trap 2 can be adapted in a suitable manner.

Parasitic interference frequencies $f_R$ that lead to lines in the recorded mass spectrum that are not produced by the ions 4*a*, 4*b* stored in the FT-ICR ion trap 2 may occur when recording mass spectra via the mass spectrometer 1. Such interference frequencies $f_R$ may lead to an incorrect interpretation of the mass spectrum.

In order to identify and optionally eliminate interference frequencies $f_R$ in the mass spectrum, use can be made of a method that is described below: in a first step, the ions 4*a*, 4*b* in the FT-ICR ion trap 2 are excited via a SWIFT excitation and subsequently detected in order to record a first frequency spectrum 13*a* of the ion resonance frequencies $f_{ion}$ (illustrated using dashed lines in FIG. 9). In a second step, the ion resonance frequencies $f_{ion}$ of the ions 4*a*, 4*b* in the FT-ICR ion trap 2 are modified and, in a third step, the ions 4*a*, 4*b* are again excited via a SWIFT excitation 10 and subsequently detected, with a second frequency spectrum 13*b* being recorded, the latter being illustrated in FIG. 9 using full lines.

Figure 9:
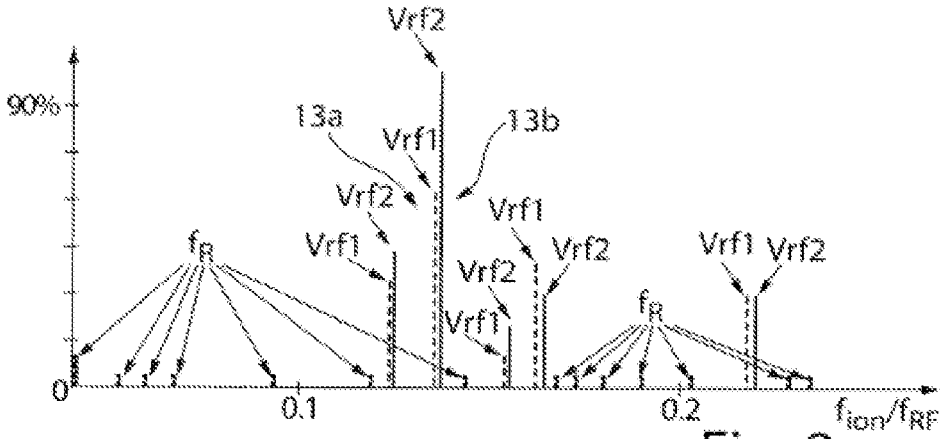
FIG. 9 shows a schematic illustration of two frequency spectra that are recorded at different storage voltages.

When comparing the two frequency spectra 13*a*, 13*b* shown in FIG. 9, it can be clearly seen that the first frequency spectrum 13*a* and the second frequency spectrum 13*b* have lines whose frequencies are practically not displaced when the ion resonance frequencies $f_{ion}$ in the FT-ICR ion trap 2 are changed such that their position practically corresponds in both frequency spectra 13*a*, 13*b*. These lines can be identified or determined as interference frequencies $f_R$. By contrast, the lines in the two frequency spectra 13*a*, 13*b* that can be systematically displaced by modifying the ion resonance frequencies $f_{ion}$ can be assigned to the ions 4*a*, 4*b* stored in the FT-ICR ion trap 2, i.e. the lines are "real" ion resonance frequencies $f_{ion}$.

As indicated in FIG. 9, the storage voltage $V_{RF}$ of the FT-ICR ion trap 2 was changed from a first value Vrf1 to a second value Vrf2 for the purposes of modifying the ion resonance frequencies $f_{ion}$. Since the ion resonance frequency $f_{ion}$ is directly proportional to the storage voltage $V_{RF}$ in the case of the predetermined mass-to-charge ratio m/z, the ion resonance frequencies $f_{ion}$ can be shifted by modifying the storage voltage $V_{RF}$. Since the ion resonance frequency $f_{ion}$ is inversely proportional to the square of the storage frequency $f_{RF}$ at a given mass-to-charge ratio m/z, a change in the ion resonance frequencies $f_{ion}$ can be effectuated, alternatively or additionally, by a change in the storage frequency $f_{RF}$ as well.

As an alternative or in addition to a change in the ion resonance frequencies $f_{ion}$, there can be a change in the phase angle φ and/or the oscillation amplitude $z/z_0$ of the trajectories B of the ions 4*a*, 4*b* in the FT-ICR iron trap 2 in the second step, for example via a mass-dependent SWIFT excitation 10, as is illustrated in FIGS. 6*a-c* in an exemplary manner. The trajectories of the ions 4*a*, 4*b* are modified in the case of such a SWIFT excitation; this becomes noticeable, for example, by a change in the heights of the lines of the second frequency spectrum 13*b* in comparison with the first frequency spectrum 13*a*. By contrast, the SWIFT excitation 10 has practically no influence on the interference frequencies $f_R$, and so the interference frequencies $f_R$ also can be detected or identified in this variant by a comparison of the two frequency spectra 13*a*, 13*b*.

A further application of a SWIFT excitation 10 consists in the determination of the charge polarities (positive/negative) of the ions 4*a*, 4*b* that are stored in the electric FT-ICR ion trap 2. In order to determine or identify the positively charged ions 4*a* and the negatively charged ions 4*b* in the FT-ICR ion trap 2, a phase angle $\alpha_0$ of the trajectory B at the start of the detection, i.e. immediately after the SWIFT excitation 10 is determined initially at a predetermined ion resonance frequency $f_{ion}$ in accordance with formula (2) specified further above, which is reproduced again below:

the following emerges from $$\frac{1}{2}\cos(\alpha_0) = \left[\frac{1}{T_0 * \hat{u}_{ion}} \int_0^{T_0} u_{ion}(t) * \cos(2\pi f_{ion} * t + \varphi)dt\right]: \tag{2}$$

$$\alpha_0 = \cos^{-1}\left(2 * \frac{1}{T_0 * \hat{u}_{ion}} \int_0^{T_0} u_{ion}(t) * \cos(2\pi f_{ion} * t + \varphi)dt\right)$$

where φ denotes a start phase of the SWIFT excitation 10 of the ions 4*a*, 4*b* at the ion resonance frequency $f_{ion}$, $\hat{u}_{ion}$ denotes the maximum of the absolute value of the ion signal $u_{ion}(t)$ at the start of the measurement and where the following applies: $T_0 >> 1/f_{ion}$ and $T_0 = N_0 \times 1/f_{ion}$ and No integer >>1. Typically, the value of the amplitude or the envelope of the oscillating ion signal $\hat{u}_{ion}$ changes only slightly during the measurement time interval $T_0$, i.e. the duration of the measurement interval To is significantly shorter than the mean free time of flight of the ions.

Figure 10A:
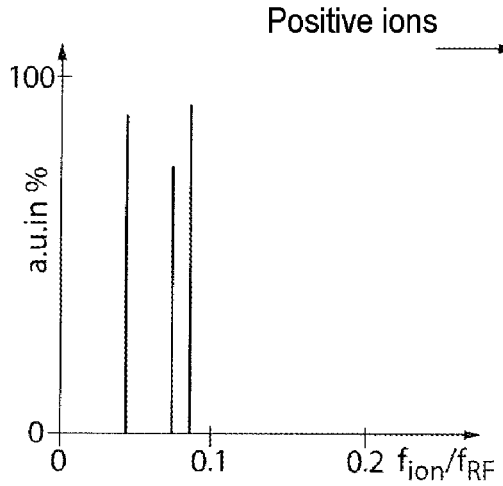
FIGS. 10*a*-10*d* show schematic illustrations of the frequency spectra of positively charged ions (FIG. 10*a*) and negatively charged ions (FIG. 10*b*) stored in the FT-ICR ion trap and of all ions stored in the FT-ICR ion trap (FIG. 10*c* and FIG. 10*d*).
Figure 10C:
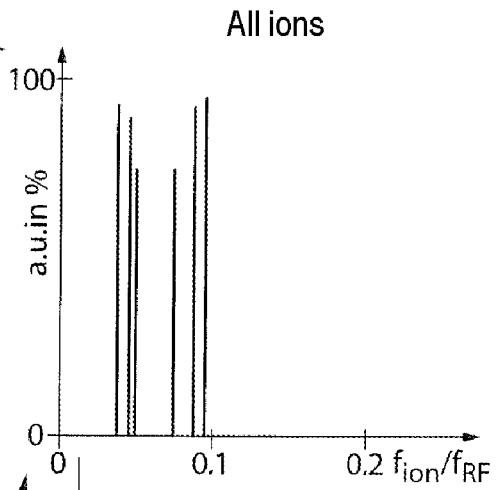
Figure 10B:
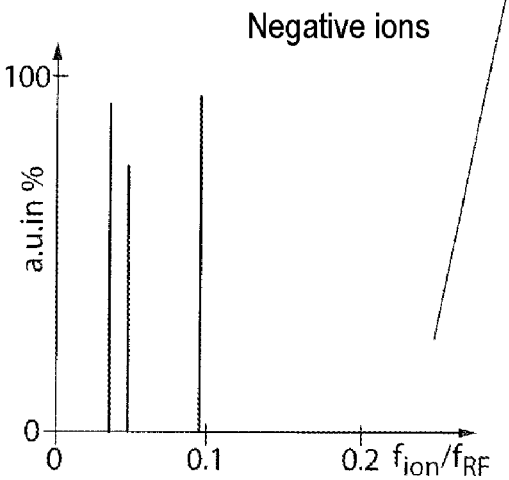

In the electric FT-ICR ion trap 2, it is possible to capture both positively charged ions 4*a* and negatively charged ions 4*b* at the same time. All ions 4*a*, 4*b* are detected after the SWIFT excitation 10 independently of their charge polarity, as a result of which e.g. a frequency spectrum which is illustrated in FIG. 10*c* may arise. The frequency spectrum, shown in FIG. 10*c*, of all ions 4*a*, 4*b* stored in the FT-ICR ion trap represents a superposition of the frequency spectrum of the positively charged ions 4*a*, which is illustrated in FIG. 10*a*, and of the frequency spectrum of the negatively charged ions 4*b*, which is illustrated in FIG. 10*b*.

By evaluating the phase angle $\alpha_0$ of the ion movement or of the trajectory B of the ions 4*a*, 4*b* after the SWIFT excitation, it is possible to detect the charge polarity of the ions 4*a*, 4*b*. If the ions 4*a*, 4*b* are stimulated by uniform broadband excitation, e.g. the positively charged ions 4*a* move toward the first measurement electrode 6*a* immediately after the SWIFT excitation 10 while the negatively charged ions 4*b* move away therefrom.

Figure 10D:
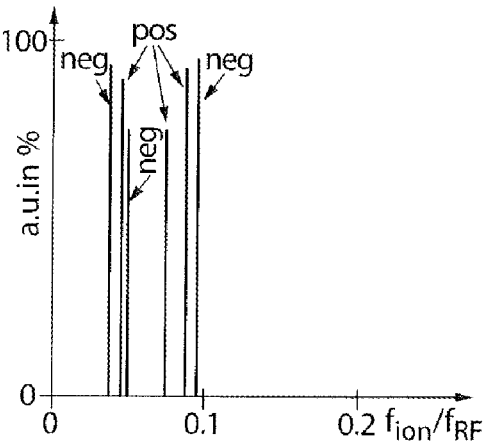

By way of example, if the following formula is applied for each ion resonance frequency $f_{ion}$, which corresponds to a line in the frequency spectrum shown in FIG. 10*c*, $$\text{polarity} = \text{sign}\left[\frac{1}{T_0 * \hat{u}_{ion}} \int_0^{T_0} u_{ion}(t) * \cos(2\pi f_{ion} * t + \varphi)dt\right], \tag{3}$$

the positive ions 4*a* can be identified e.g. on the basis of a positive sign ($\alpha_0$=0°, polarity +1) and the negative ions 4*b* can be identified on the basis of a negative sign ($\alpha_0$=180°, polarity −1). In this way, the positive ions 4*a* and the negative ions 4*b* can be identified in the frequency spectrum of all ions 4*a*, 4*b*, as illustrated in FIG. 10*d*.

In the example described above, the assumption is made that the SWIFT excitation 10 is carried out with a start phase $\varphi=0$. However, as was described further above, the start phase $\varphi$ may also be varied depending on the ion resonance frequency $f_{ion}$ in the case of a mass-dependent phase-shifted orbital SWIFT excitation 10. In this way, ion packets in the frequency spectrum or in the mass spectrum can be accordingly marked differently.

If the charge polarity (positive/negative or +/−) of the ions 4*a*, 4*b* is known, ion populations can be excited differently depending on their charge polarity, for example by a SWIFT (broadband-)selective excitation 10. This can be effectuated by virtue of different excitation transients being applied to the measurement electrodes 6*a*, 6*b* depending on the charge polarity at the respectively associated ion resonance frequencies $f_{ion}$. It is understood that the procedure described above is not restricted to the electrode geometry of the FT-ICR ion trap shown in FIG. 1, i.e. this method can be applied to measurement electrodes with different electrode geometries, for example to measurement electrodes in the form of measurement tips in the end caps or in the form of toroidal measurement caps of a toroidal ion trap, etc.

In conclusion, the performance characteristics of a mass spectrometer 1 having an FT ion trap 2 can be significantly increased in the manner described further above.

What is claimed is:

1. A method, comprising:

producing ions by ionizing a gas;

storing at least some of the ions in an FT ion trap; and detecting at least some of the ions in the FT ion trap, wherein at least one of the following holds:

i) producing the ions comprises exposing the ions to an IFT excitation based on a mass-to-charge ratio of the ions;

ii) storing the ions in the FT ion trap comprises exposing the ions to an IFT excitation based on a mass-to-charge ratio of the ions; and iii) before detecting the ions in the FT ion trap, exposing the ions to an IFT excitation based on a mass-to-charge ratio of the ions, and wherein:

a degree of excitation and/or a phase angle of the IFT excitation are varied between a first excitation frequency and a second excitation frequency; and both the first excitation frequency and the second excitation frequency deviate from a predetermined excitation frequency by no more than 10%.

2. The method of claim 1, wherein i) holds, and the IFT excitation is used to select ions to store in the FT ion trap.

3. The method of claim 2, wherein ii) holds.

4. The method of claim 3, wherein iii) holds.

5. The method of claim 2, wherein iii) holds.

6. The method of claim 1, wherein ii) holds.

7. The method of claim 6, wherein iii) holds.

8. The method of claim 1, wherein iii) holds.

9. The method of claim 1, wherein the IFT excitation comprises a SWIFT excitation.

10. The method of claim 1, wherein:

at least one of i) and ii)holds; and only ions whose mass-to-charge ratio lies outside of an interval of the mass-to-charge ratios of a main gas component of the gas are selected for storage.

11. The method as claimed in claim 1, wherein the phase angle and/or the degree of excitation vary in steps between the first excitation frequency and the second excitation frequency, depending on the excitation frequency.

12. The method as claimed in claim 11, wherein the degree of excitation and/or the phase angle either increase in steps or decrease in steps between the first excitation frequency and the second excitation frequency, depending on the excitation frequency.

13. The method of claim 1, wherein the same ions are repeatedly selectively excited in the FT ion trap by IFT excitations, and detection of the ions is performed after a respective IFT excitation.

14. The method as claimed in claim 13, wherein there is a time interval between two IFT excitations that immediately follow one another in time, and the time interval is greater than a mean free time of flight of the ions in the FT ion trap.

15. The method of claim 1, further comprising examining an ion signal by mass spectrometry only in a temporally displaceable measurement time interval when detecting the ions.

16. The method of claim 1, further comprising:

exciting the ions in the FT ion trap;

recording a first frequency spectrum;

modifying a phase angle and/or an oscillation amplitude of the ions in the FT ion trap and/or modifying ion resonance frequencies of the ions in the FT ion trap, exciting the ions in the FT ion trap again and recording a second frequency spectrum; and detecting interference frequencies in the FT ion trap by comparing the first recorded frequency spectrum and the second recorded frequency spectrum.

17. The method of claim 16, wherein modifying the ion resonance frequencies comprises modifying a storage voltage and/or a storage frequency of the FT ion trap.

18. The method of claim 1, further comprising determining a start phase angle of a trajectory of ions at a given ion resonance frequency after an IFT excitation on the basis of a time-dependent ion signal recorded when detecting the ions.

19. The method of claim 18, further comprising determining a charge polarity of the ions based on the start phase angle of the ions after the IFT excitation.

20. A method, comprising:

producing ions by ionizing a gas;

storing at least some of the ions in an FT ion trap; and detecting at least some of the ions in the FT ion trap, wherein at least one of the following holds:

i) producing the ions comprises exposing the ions to an IFT excitation based on a mass-to-charge ratio of the ions;

ii) storing the ions in the FT ion trap comprises exposing the ions to an IFT excitation based on a mass-to-charge ratio of the ions; and iii) before detecting the ions in the FT ion trap, exposing the ions to an IFT excitation based on a mass-to-charge ratio of the ions, and wherein the method further comprises:

exciting the ions in the FT ion trap;

recording a first frequency spectrum;

modifying a phase angle and/or an oscillation amplitude of the ions in the FT ion trap and/or modifying ion resonance frequencies of the ions in the FT ion trap;

exciting the ions in the FT ion trap again and recording a second frequency spectrum; and detecting interference frequencies in the FT ion trap by comparing the first recorded frequency spectrum and the second recorded frequency spectrum.

21. A method, comprising:

producing ions by ionizing a gas;

storing at least some of the ions in an FT ion trap; and detecting at least some of the ions in the FT ion trap, wherein at least one of the following holds:

i) producing the ions comprises exposing the ions to an IFT excitation based on a mass-to-charge ratio of the ions;

ii) storing the ions in the FT ion trap comprises exposing the ions to an IFT excitation based on a mass-to-charge ratio of the ions; and iii) before detecting the ions in the FT ion trap, exposing the ions to an IFT excitation based on a mass-to-charge ratio of the ions, and wherein the method further comprises determining a start phase angle of a trajectory of ions at a given ion resonance frequency after an IFT excitation on the basis of a time-dependent ion signal recorded when detecting the ions.

* * * * *